United States Patent [19]

Kumano

[11] Patent Number: 4,866,843

[45] Date of Patent: Sep. 19, 1989

[54] ELECTRIC DRY SHAVER WITH TRIMMER UNIT

[75] Inventor: Fumihiro Kumano, Hikone, Japan

[73] Assignee: Matsushita Electric Works, Ltd., Japan

[21] Appl. No.: 318,412

[22] Filed: Feb. 28, 1989

Related U.S. Application Data

[63] Continuation of Ser. No. 131,679, Dec. 11, 1987, abandoned.

[30] Foreign Application Priority Data

Dec. 23, 1986 [JP] Japan ..... 61-306848

[51] Int. Cl.[4] ..... B26B 19/06

[52] U.S. Cl. ..... 30/34.1; 30/43.92

[58] Field of Search ..... 30/34.1, 43.91, 43.92, 30/346.31

[56] References Cited

U.S. PATENT DOCUMENTS

| | | | |
|---|---|---|---|
| 2,330,853 | 10/1943 | Wintercorn | 30/34.1 |
| 4,233,733 | 11/1980 | Gallanis et al. | 30/43.92 |
| 4,262,415 | 4/1981 | Braun | 30/34.1 |
| 4,481,711 | 11/1984 | Pachel et al. | 30/34.1 |

FOREIGN PATENT DOCUMENTS

| | | |
|---|---|---|
| 1051161 | 2/1959 | Fed. Rep. of Germany . |
| 2343116 | 1/1975 | Fed. Rep. of Germany . |
| 2817481 | 11/1978 | Fed. Rep. of Germany . |
| 53-128460 | 9/1978 | Japan . |
| 252844 | 10/1948 | Switzerland . |
| 602186 | 5/1948 | United Kingdom . |
| 653508 | 5/1951 | United Kingdom . |
| 659058 | 10/1951 | United Kingdom . |
| 1550371 | 8/1979 | United Kingdom . |

OTHER PUBLICATIONS

United Kingdom Search Report.

*Primary Examiner*—Douglas D. Watts

*Attorney, Agent, or Firm*—Stevens, Davis, Miller & Mosher

[57] ABSTRACT

An improved dry shaver has a shaving head mounting thereon a main shaving unit with a rounded shearing foil and at least one trimmer unit which is disposed in adjacent relation to the main shaving unit with its cutting edge directed away therefrom. A skin guide is provided outwardly of the trimmer unit in spaced relation thereto for contact with the skin of the user when manipulating the shaver across the skin. The skin guide has a contact end positioned at an elevation around an extension line connecting the apex of the shearing foil and the leading edge of the trimmer unit so that it can guide the shaving head along the skin while allowing the trimmer unit and the main shaving unit to be simultaneously in positive shearing contact with the skin. Consequently, during a single stroke of moving the shaver along the skin, the trimmer unit can serve to shear a long hair to a length sufficient to be subsequently cut by the main shaving unit, whereby enabling to cut a long hair close to the skin by the combined shearing operation in a continuous manner.

22 Claims, 5 Drawing Sheets

ELECTRIC DRY SHAVER WITH TRIMMER UNIT

This application is a continuation, of application Ser. No. 131,679, filed Dec. 11, 1987, now abandoned.

BACKGROUND OF THE INVENTION

1. Field of the invention

The present invention is directed to an electric dry shaver with at least one trimmer unit, and more particularly to such a dry shaver having the trimmer unit which is mounted adjacent to a main shaving unit in an operatively associated relation thereto for effecting a combined operation of cutting a long hair bristle by these units.

2. Description of the prior art

Electric shavers with a trimmer unit have been known in which the trimmer unit is mounded in closely spaced relation to a main shaving unit, for example as disclosed in U.S. Pat. Nos. 4,262,415 and 3,950,847. Although it is possible with these prior shavers to simultaneously operate the main shaving unit and the trimmer unit to cut hairs while manipulating the shaver across the skin of the user, there is required a delicate technique to maintain both units in optimum shearing contacts with the skin of the user for continuing cutting while preventing the skin from being injured by the cutting edge of the trimmer unit. Therefore, the prior shavers are not safe enough to perform the cutting simultaneously with the main shearing and trimmer units.

SUMMARY OF THE INVENTION

In view of the above problem, the present invention has been accomplished and presents an improved electric shaver with a trimmer unit in which a main shaving unit and the trimmer unit can be in positive contact relation with the skin of the user by means of a skin guide mounted adjacent the trimmer unit for effecting safe cutting operations by these units. The above cutting mode is particularly desired when the shaver is used by women to shave leg hair which requires closing shaving by the main shaving unit after shearing the leg hair by the trimmer unit to a length acceptable by the main shaving unit.

The dry shaver in accordance with the present invention comprises the main shaving unit and at least one trimmer unit mounted in an adjacent relation with the main shaving unit. The main shaving unit includes a rounded shearing foil and an inner blade assembly driven to move in shearing engagement therewith, while the trimmer unit includes a stationary blade and a movable blade which is driven simultaneously with said inner blade assembly to reciprocate along the stationary blade for cutting a long hair. The cutting edge of the trimmer unit is directed away from the main shaving unit. The shaver is characterized to include a skin guide which is located adjacent to the trimmer unit away from the main shaving unit and which is adapted to be in contact with the skin of a user for guiding the trimmer unit and the main shaving unit therealong. For this purpose, the skin guide has its upper contact end positioned around an extension line connecting the apex of the shearing foil and the leading edge of the trimmer unit. Consequently, it is assured that the contact end of the skin guide, the cutting edge of the trimmer unit, and the apex of the main shaving unit can be simultaneously in positive contact with the skin, thus allowing the simultaneous hair shearing and cutting operation by these units. Experiment shows that the upper contact end of the skin guide is preferably lowered from the extension line by a distance of 0.5 to 2.0 mm for providing an optimum hair shearing contacts of the main shearing and trimmer units. It is possible with this advantageous feature to firstly shear a relatively long hair to a short length by the trimmer unit in advance of the main shearing unit and immediately thereafter to cut it close to the skin by the main shaving unit while keeping the both units in positive contact relation to the skin of the user.

Accordingly, it is a primary object of the present invention to provide a dry shaver in which the trimmer unit can be cooperative with the main shaving unit to provide a close shave for a long hair in a safe and continuous manner in a single stroke of moving the shaver across the skin of the user.

In a preferred embodiment, the shaver has a pair of trimmer units which are mounted together with the main shaving unit on a shaving head so as to be disposed on both sides of the main shaving unit. The shearing foil of the main shaving unit is shaped into a part-cylindrical configuration having a horizontal axis along which the inner blade assembly is driven to reciprocate in shearing engagement with the undersurface of the shearing foil. Each trimmer unit has its cutting edge directed away from the main shaving unit and toward each of the skin guides which are provided in the peripheries of the shaving head in spaced relation from the adjacent trimmer unit. Thus, one of the trimmer unit can be always cooperative with the main shaving unit when the shaver is moved in either of directions transversely of the length of the shearing foil so as to assure the above combination shaving.

It is therefore another object of the present invention to provide a dry shaver with a pair of trimmer units which has a bidirectional capability of performing the combined shaving by one of the trimmer units and the main shaving unit.

The stationary and the movable blades of the trimmer unit define therebetween a cutting plane which is inclined with respect to the tangent plane to the apex of the shearing foil so that the trimmer blades can be held at a suitable cutting angle to the skin for effective shearing simultaneously with the shearing by the main shaving unit. Further, the stationary blade has its slotted leading edge bent along the above extension line to form thereat a comb-like guide lip for contact with the skin of the user. The cooperative stationary blade has its leading edge retreated from the guide lip so that the guide lip can serve as an additional guide to smoothly guide the trimmer unit along the skin and also as a comb for feeding a hair to the edge of the movable blade, while preventing the movable blade from protruding into and injuring the skin.

It is therefore a further object of the present invention to provide a dry shaver in which the trimmer unit can be brought into effective shearing contact with the skin together with the main shaving unit and in which the leading edge of the stationary blade can be effectively utilized to guide the trimmer unit along the skin, yet preventing the injury of the skin by the movable blade.

A still further advantageous feature of the present invention is that the movable blade having a smaller thickness than the stationary blade is placed on the top or upper surface of the stationary blade in order to make the cutting plane thereof closer to the skin and therefore obtain a closer shave than the case in which the blades are placed oppositely. In order to nevertheless prevent the cutting edge of the movable blade from contacting and injuring the skin, a trimmer support mounting the stationary and movable blades is utilized to provide a guard surface which projects above the movable blade and lies nearly along the above extension line connecting the apex of the shearing foil and the cutting edge of the trimmer unit. Thus, during the simultaneous cutting operations of the main shaving unit and the trimmer unit, the trimmer unit can cut a long hair to short sufficient enough for introducing it to main shaving unit, thereby improving the combined cutting effect, yet preventing the movable blade from injuring the skin, which is therefore a still further object of the present invention.

Formed on the portion of the skin guard is a round recess the bottom surface of which terminates at its end in the contact end or the upper end of the skin guard and has a radius of not less than 0.5 mm centered on the cutting edge of the trimmer unit. With this provision of the recess, a long hair once lied flat against the surface of the skin when entering over the contact end of the skin guide can lift back within the space of this recess so that it can be successfully sheared by the trimmer unit.

It is therefore a further object of the present invention to provide a dry shaver with a trimmer which is capable of effectively introducing or combing a long hair into the cutting edge of the trimmer unit while keeping the skin guide in contact with the skin.

In the shaver with a pair of trimmer units, one of the trimmer units is made vertically movable between a normal position in which the leading edge of the trimmer unit defines the above extension line with the apex of the shearing foil and a raised position in which it projects above the apex of the shearing foil. Alternatively in a modified form of the present invention, one of the skin guides is made vertically movable between a normal position where the contact end of the skin guide is around the above extension line and a lowered position where it is lowered by a greater distance from said extension line. Consequently, the trimmer unit can be used independently of the main shaving unit as necessary, for instance, to shave underarm hair or other long hair areas, which is therefore a further object of the present invention.

The present invention disclose a still further advantageous feature for reducing the number of components for the trimmer unit by the use of the trimmer support integrally formed with a trimmer drive which interconnects the movable blade of the trimmer blade and a drive element for the inner blade assembly and which joins the support through a pair of resilient legs so that it is movable relative to the support.

These and still other objects and advantages will be apparent from the following detailed description of the preferred embodiment of the present invention when taken in conjunction with the accompanying drawings.

DETAILED DESCRIPTION OF THE EMBODIMENT

Figure 1:
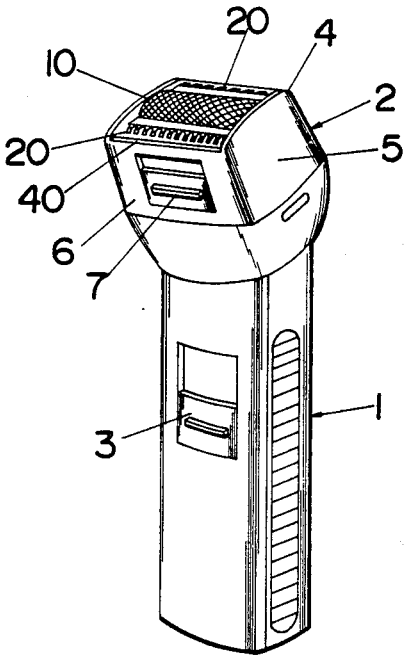
FIG. 1 is a perspective view of a dry shaver in accordance with a preferred embodiment of the present invention.

Referring to FIG. 1, an electric dry shaver in accordance with a preferred embodiment of the present invention comprises a housing 1 and a shaving head 2 detachably mounted thereon. The housing 1 accommodates therein an electric motor (not shown) which is energized through the operation of a switch handle 3 by a battery (not shown) also accommodated in the housing 1.

The shaving head 2 comprises a generally rectangular head frame 4 defined by opposed end walls 5 and opposed side walls 6. The shaving head 2 is detachable to the housing 1 and mounts therein a main shaving unit 10 and a pair of trimmer units 20 which are driven by the motor for simultaneous shearing and cutting operations. The main shaving unit 10 includes a shearing foil 11 which is curved into a part-cylindrical configuration within the upper opening of the head frame 4 with its marginal portions secured to the head frame 4 by hooks 12. Cooperative with the shearing foil 11 is an inner blade assembly 13 which has a plurality of arcuate blades 14 mounted on a block 15. The block 15 is connected to a main drive element 16 which translates the rotary motion of the motor into the reciprocating motion of the inner blade assembly 13 so that the inner blade assembly 13 is driven to reciprocate along the axis of the part-cylindrical shearing foil 11 in hair shearing engagement therewith.

Figure 2:
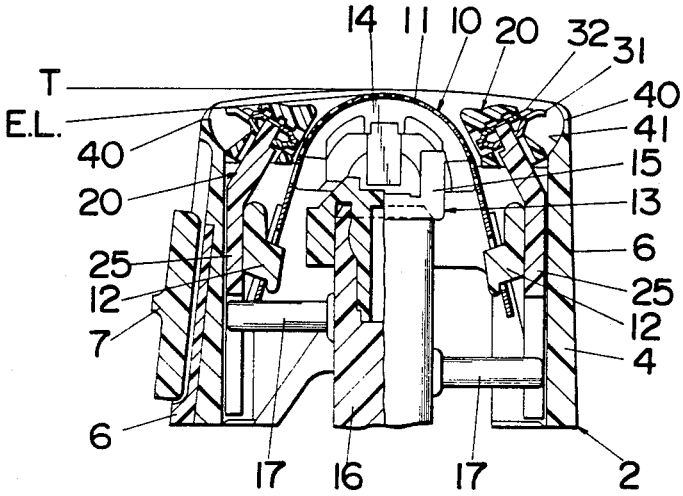
FIG. 2 is a sectional view of a shaving head of the above shaver.
Figure 3:
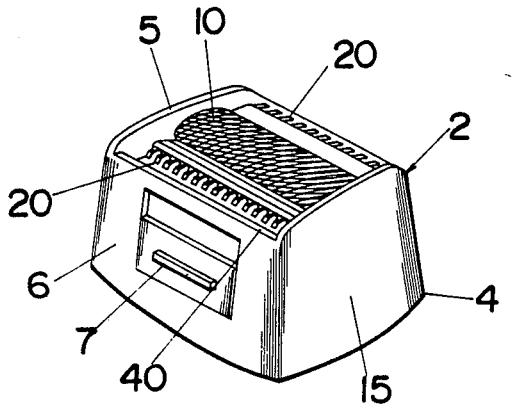
FIG. 3 is a perspective view of the shaving head.
Figure 4:
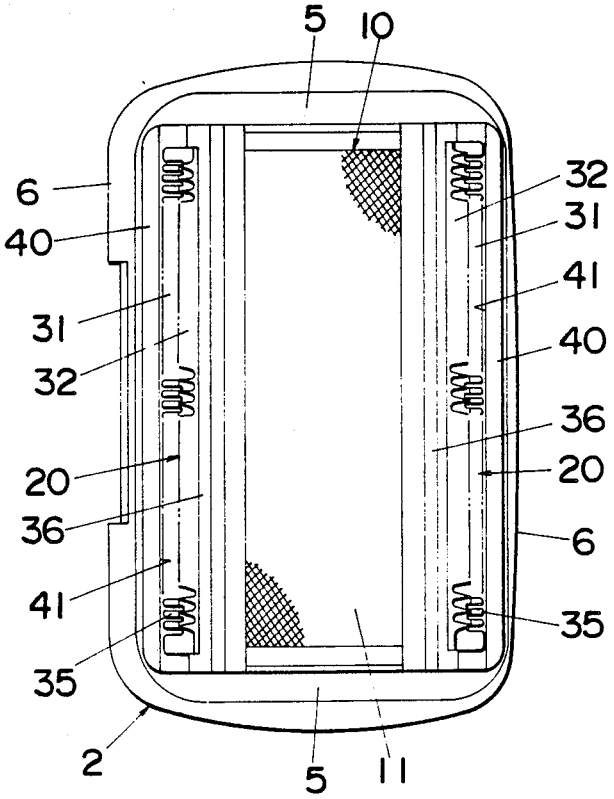
FIG. 4 is a top view of the shaving head.
Figure 5:
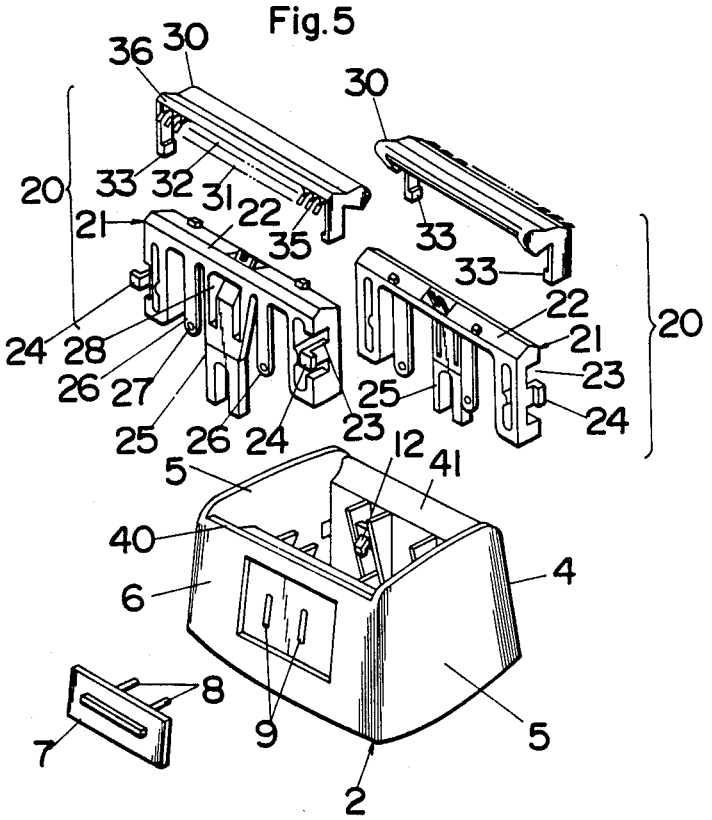
FIG. 5 is an exploded perspective view of the shaving head.
Figure 6:
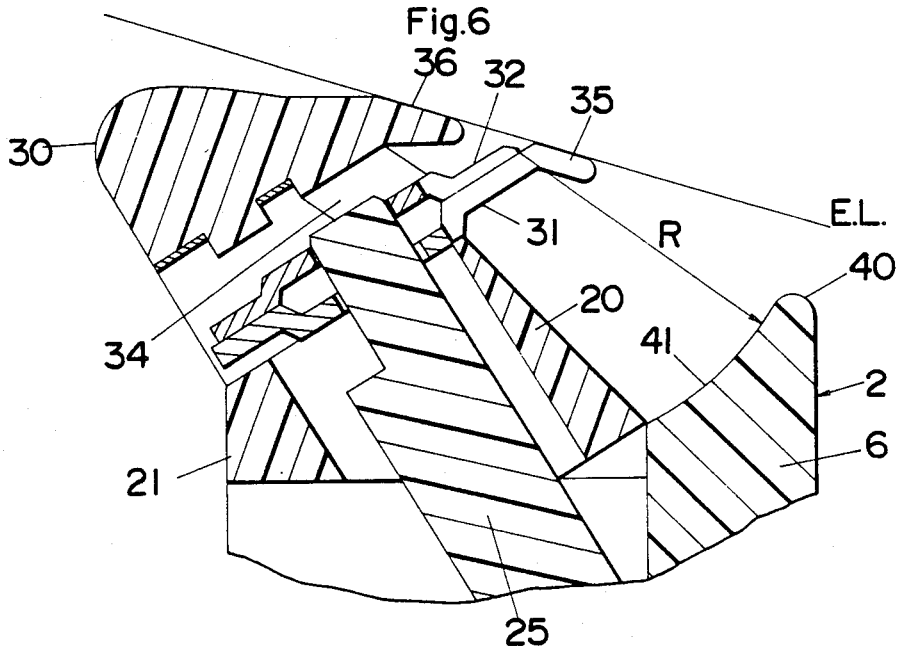
FIG. 6 is an enlarged partial view of a trimmer unit mounted in the shaving head.

As shown in FIGS. 2, 5 and 6, the trimmer unit 20 comprises a trimmer support 21 of a plastic material mounting thereon a stationary blade 31 and a movable blade 32 driven to reciprocate on the top surface of the stationary blade 31 in hair shearing engagement therewith. The support 21 is composed of a base 22 and a trimmer cap 30 which carries the stationary blade 31 and the movable blade 32 together and is secured to the base 22 with barb projections 33 at its ends engaged with notches 23 in the ends of the base 22. Each of the trimmer units 20 is secured to the inside of each side wall 6 of the head frame 4 by means of end latches 24 provided at the ends of the base 22. A leaf spring 34 is provided in the cap 30 to urge the movable blade 32 against the stationary blade 31.

Integrally molded with the base 22 is a trimmer drive 25 which is connected through a pair of resilient legs 28 to the body of the base 22 to be capable of resiliently moving in the lengthwise direction of the base 22 relative thereto. The trimmer drive 25 has its upper end projected above the base 22 and through the stationary blade 31 for connection with the movable blade 32. The lower end of the trimmer drive 25 is bifurcated for connection with one of rods 17 extending laterally from the main drive element 16 so that each of the trimmer units 20 is driven simultaneously with the main shaving unit 10.

Each trimmer unit 20 is disposed adjacent the main shaving unit 10 in such a manner as to direct its cutting edge away therefrom with its cutting plane defined between the blades 31 and 32 being inclined with respect to a tangent plane T to the apex of the shearing foil 11. The trimmer unit 20 has its cutting edge extending substantially the full length between the end walls 5 of the head frame 4 in parallel relation with the axis of the shearing foil 11 which also so extends between the end walls 5.

Each of the side walls 6 of the head frame 4 is spaced outwardly from the cutting edge of the adjacent trimmer unit 20 to define at its upper end a skin guide 40 which is located just below an extension line E.L. connecting the apex of the shearing foil 11 and the leading edge of the trimmer unit 20, as best shown in FIGS. 2 and 6. The skin guide 40 serves to be in contact with the skin of user during the manipulation of the shaver across the skin so as to bring the cutting edge of the adjacent trimmer unit 20 and the cutting surface of the main shaving unit 10 into a positive contact relation with the skin at the same time. Through several experiments with due consideration to the manner in which the shaver is manipulated and the configuration of the surface areas to be shaved, it is found that the above extension line E.L is preferably inclined at a angle of not more than 10° with respect to the tangent to the apex of the main shaving unit 10 and that the upper contact end of the skin guide 40 is lowered preferably by a distance of between 0.5 to 2.0 mm from the extension line E.L. for effectively achieving the simultaneous shearing and cutting operations by these units 10 and 20.

In each trimmer unit 20 the stationary blade 31 has its toothed leading end portion bent along the extension line E.L. to form thereat a comb-like guide lip 35 which extends toward the skin guide 40 and serves not only as an additional guide means in contact with the skin but also as a comb for feeding hair bristles into the leading edge of the movable blade 32 or the cutting edge of the trimmer unit 20. It is noted in this connection, the movable blade 32 positioned closer to the skin has a thickness smaller than the stationary blade 31 so that the trimmer unit 20 can effect a closer shave than the case in which the stationary blade 31 of greater thickness is closer to the skin. Although the movable blade 32 is positioned closer to the skin, it is protected by the trimmer cap 30 from contacting with and injuring the skin during use. Particularly, the trimmer cap 30 includes a flat guard surface 36 which lies substantially along the above extension line E.L., as best shown in FIG. 6 so that it is cooperative with the skin guide 40 and the guide lip 35 to smoothly guide the shaver along the skin while preventing the cutting edge of the movable blade 32 from injuring the skin. It is noted at this time that the leading edge of the movable blade 32 which defines the cutting edge of the trimmer unit 20 is retracted from the guide lip 35 or the extension line E.L.

Figure 7:
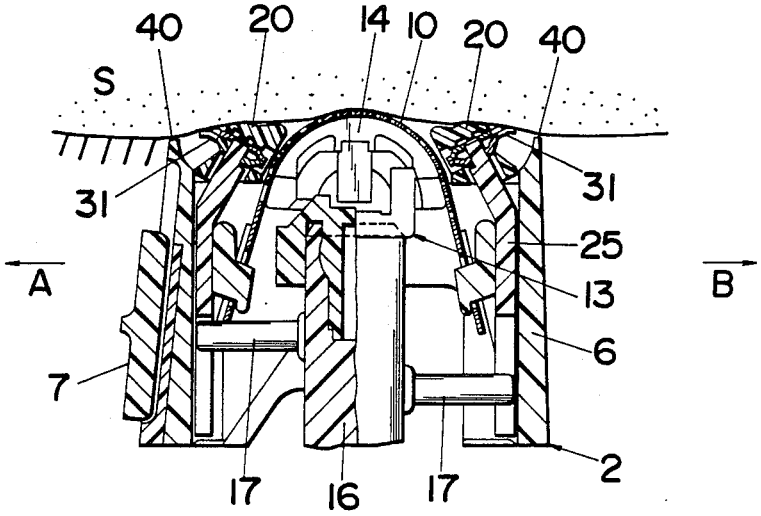
FIG. 7 is an explanatory view illustrating the combined operation of the shaving head.

In operation, the shaver is placed against the skin S, as shown in FIG. 7, and is moved therealong with one of the trimmer units 20 leading the main shaving unit 10. In moving the shaver, for example, in the direction A of the figure, the skin guide 40 (left one in the figure) adjacent the leading trimmer unit 20 acts to hold the cutting edge of the leading trimmer unit 20 and the cutting surface of the main shaving unit 10 simultaneously in positive contact with the skin S for ensuring the combined cutting or shearing. That is, a long hair is firstly sheared by the leading trimmer unit 20 (left one in the figure) to a length acceptable by the main shaving unit 10 in advance of the main shaving unit 10 and is subsequently cut thereby to a close to the skin. In this manner, the long hair can be cut to the skin by the combination of the trimmer unit 20 and the main shaving unit 10 within a single stroke of manipulating the shaver along the skin S. It should be noted at this time that since the trimmer units 20 are disposed on both sides of the main shaving unit 10, the above combination cutting can be effected either in moving the shaver in the direction of A or B of the figure, in the latter case the right trimmer unit 20 will lead the main shaving unit 10 as guided by the right skin guide 40. In this sense the shaver is bidirectional with the combination cutting feature.

Figure 8:
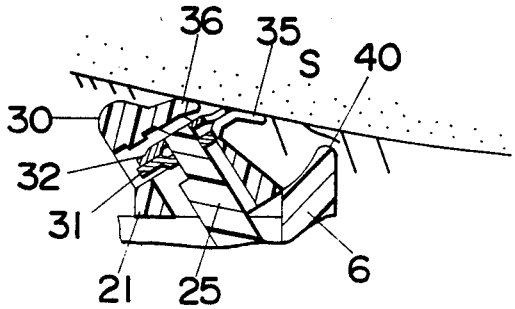
FIGS. 8 and 9 are explanatory views respectively illustrating the cutting operation of the trimmer unit.
Figure 9:
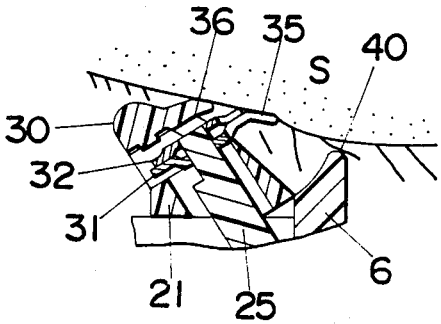

Turning back to FIGS. 5 and 6, the side wall 6 of the head frame 4 is formed on its upper inner periphery with a rounded recess 41 the bottom surface of which has a radius R of not less than 0.5 mm centered on the cutting edge of the adjacent trimmer unit 20 and which terminates at its upper end in said contact end of the skin guide 40. Thus, a long hair which is caused to lie flat against the skin S when passing over the skin guide 40 can be easily lifted within the rounded recess 41 by itself and/or by the combing effect of the guide lip 35, as shown in FIG. 8, so that it can be easily captured and sheared by the trimmer unit 20. In addition, the provision of locating the contact end of the skin guide 40 at an elevation a slight distance 0.5 to 2.0 mm from the extension line E.L. is found pertinent in preventing a long hair from excessively lying flat against the skin. The guide lip 35 has its extreme end rounded so that it will not irritate the skin when the shaver is moving along the skin with being pressed thereagainst, as shown in FIG. 9.

Figure 10:
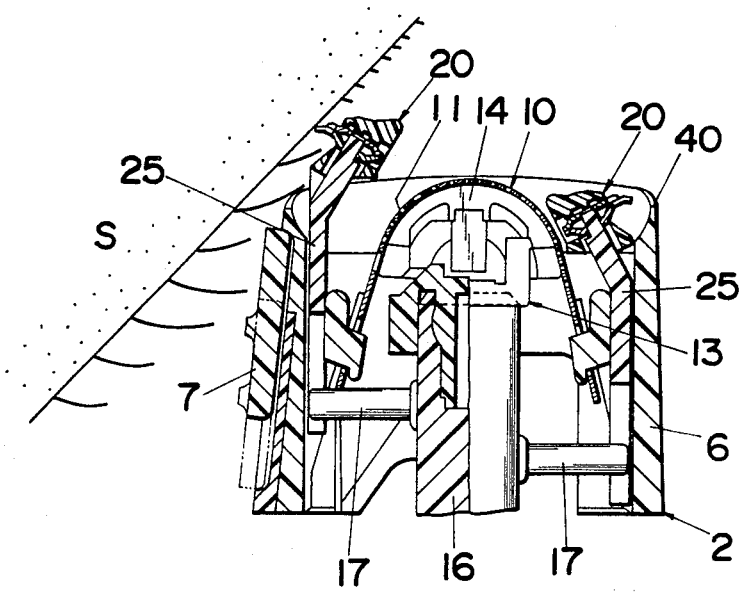
FIG. 10 is an explanatory view illustrating the operation of the trimmer unit in its raised position.

In the shaver of the above embodiment, one of the trimmer units 20 is connected to a slide knob 7 on the outer surface of the side wall 6 of the head frame 4 and is movable vertically by the operation thereof between a normal position where its cutting edge defines the above extension line E.L. and a raised position of FIG. 10 where its cutting edge projects above the apex of the main shaving unit 10. Thus, as shown in FIG. 10, the trimmer unit 20 in its raised position can be alone utilized for trimming of long hair areas. The connection between the slide knob 7 and the trimmer unit 10 is made by a pair of integral pins 8 which extend from the slide knob 7 through vertical slots 9 in the side wall 6 of the head frame 4 and engage into apertures 27 at the respective lower ends of depending bars 26 integrally formed with the trimmer support 21.

Figure 11:
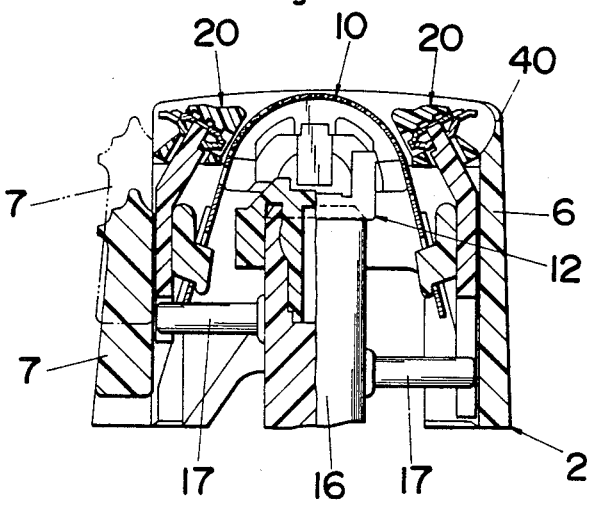
FIG. 11 is a sectional view of the like shaving head of a modification of the present invention, with one of skin guides shown in its lowered position.

In FIG. 11, there is shown a modification of the above embodiment in which, instead of the trimmer unit 20 being movable, one of the side walls 6 is movable relative to the other portions of the head frame 4 and the fixed trimmer units 20 between a normal position shown in dotted lines where its upper end defining the like skin guide 40 is in the prescribed relation to the cutting edge of the trimmer unit 20 and a lowered position shown in solid lines where the skin guide 40 is lowered considerably to expose the cutting edge of the trimmer unit 20.

What is claimed is:

1. In a dry shaver comprising a main shaving unit and at least one trimmer unit mounted in an adjacent relation with said main shaving unit, said main shaving unit including a rounded shearing foil and an inner blade assembly driven to move in shearing engagement therewith, said trimmer unit including a stationary blade and a movable blade positioned above the stationary blade and which is driven simultaneously with said inner blade assembly to reciprocate along the stationary blade for cutting a long hair, said trimmer unit having its cutting edge directed oppositely from said main shaving unit, said stationary and movable blades defining therebetween a cutting plane which is inclined with respect to a tangent plane to the apex of said shearing foil, said stationary blade having a toothed leading end portion bent along an extension line connecting the apex of said shearing foil and the leading edge of said trimmer unit to form thereat a comb-like guide lip for contact with the skin of the user, and said movable blade having its leading edge retreated inwardly from said guide lip, said guide lip being rounded at its extreme end, said shaver including a skin guide which is mounted adjacent to said trimmer unit away from said main shaving unit and is adapted to be in contact with the skin of a user for guiding said trimmer unit and said main shaving unit therealong, said skin guide having its contact end located around said extension line such that said contact end of the skin guide, said cutting edge of the trimmer unit, and the apex of said main shaving unit can be simultaneous in contact with the skin for allowing the simultaneous hair shearing and cutting operations by these units.

2. A dry shaver as set forth in claim 1, wherein said shearing foil is curved into a part-cylindrical shape to have an axis along which said inner blade assembly is driven to reciprocate, and wherein said trimmer unit has the length of cutting edge substantially equal to the length of said shearing foil along its axis.

3. A dry shaver as set forth in claim 1, wherein said extension line crosses at an angle of not more than 10 degrees with the tangent to the apex of said shearing foil.

4. A dry shaver as set forth in claim 1, wherein said contact end of the skin guide is lowered from said extension line by a short distance of 0.5 to 2.0 mm.

5. A dry shaver as set forth in claim 1, wherein said skin guide includes a round recess the bottom surface of which terminates at its end in said contact end and has a radius of not less than 0.5 mm centered on the cutting edge of the trimmer unit.

6. A dry shaver as set forth in claim 1, wherein said trimmer unit includes a support on which the stationary and movable blades are mounted, said support having a flat guard surface which lies nearly along said extension line.

7. A dry shaver as set forth in claim 1, wherein said movable blade has a thickness smaller than said stationary blade and is driven to reciprocate on the top surface of said stationary blade.

8. A dry shaver as set forth in claim 1, wherein said trimmer unit is vertically movable between a normal position in which the leading edge of the trimmer unit defines with the apex of the shearing foil said extension line and a raised position in which it projects above the apex of the shearing foil.

9. A dry shaver as set forth in claim 1, wherein said skin guide is vertically movable between a normal position where the contact end of the skin guide is around said extension line and a lowered position where it is lowered by a greater distance from said extension line.

10. A dry shaver as set forth in claim 1, wherein said trimmer unit includes a support on which the stationary and movable blades are mounted, said support being integrally formed with a trimmer drive operatively connecting the trimmer blade to a drive element for said inner blade assembly, said trimmer drive joining said support through a pair of resilient legs so that it is movable relative to the support.

11. In a dry shaver comprising a shaving head on which a main shaving unit and a pair of trimmer units are mounted with the trimmer units being disposed on both sides of said main shaving unit in an adjacent relation therewith, said main shaving unit including a rounded shearing foil and an inner blade assembly driven to move in shearing engagement therewith, each of said trimmer units including a stationary blade and a movable blade which is driven simultaneously with said inner blade assembly to reciprocate therealong for cutting a long hair, each trimmer unit having its cutting edge directed oppositely from said main shaving unit, said shaver characterized to include a pair of skin guides each of which is mounted adjacent to the corresponding trimmer unit away from said main shaving unit and is adapted to be in contact with the skin of a user for guiding said trimmer unit and the main shaving unit therealong, each of said skin guides having its contact end located around an extension line connecting the apex of said shearing foil and the leading edge of said trimmer unit such that said contact end of at least one of said skin guides, said cutting edge of at least one of said trimmer units, and the apex of said main shaving unit can be simultaneously brought into contact with the skin for allowing the simultaneous hair shearing and cutting operations by these units.

12. A dry shaver as set forth in claim 11, wherein said shearing foil is curved into a part-cylindrical shape to have an axis along which said inner blade assembly is driven to reciprocate, and wherein each of said trimmer units has the length of cutting edge substantially equal to the length of said shearing foil along its axis.

13. A dry shaver as set forth in claim 11, wherein said extension line crosses at an angle of not more that 10 degrees with he tangent to the apex of said shearing foil.

14. A dry shaver as set forth in claim 11, wherein said contact end of each skin guide is lowered from said extension line by a short distance of 0.5 to 2.0 mm.

15. A dry shaver as set forth in claim 11, wherein each of said skin guides includes a round recess the bottom of which terminates at its end in said contact end of the skin guide and has a radius of not less than 0.5 mm centered on the cutting edge of the trimmer unit.

16. A dry shaver as set forth in claim 11, wherein each of said trimmer units includes a support on which the stationary and movable blades are mounted, said support having a flat guard surface which lies nearly along said extension line.

17. A dry shaver as set forth in claim 11, wherein said stationary and movable blades of each of said trimmer units defines therebetween a cutting plane which is inclined with respect to the tangent plane to the apex of said shearing foil, said stationary blade having its toothed leading end portion bent along said extension line to form thereat a comb-like guide lip for contact with the skin of the user, and said movable blade having its leading edge receded inwardly from said guide lip.

18. A dry shaver as set forth in claim 17, wherein said guide lip is rounded at its extreme end.

19. A dry shaver as set forth in claim 17, wherein said movable blade has a thickness smaller than said stationary blade and is driven to reciprocate on the top surface of said stationary blade.

20. A dry shaver as set forth in claim 11, wherein one of said trimmer units is vertically movable between a normal position in which the leading edge of the trimmer unit defines with the apex of the shearing foil said extension line and a raised position in which it projects above the apex of the shearing foil.

21. A dry shaver as set forth in claim 11, wherein one of said skin guides is vertically movable between a normal position where the contact end of the skin guide is around said extension line and a lowered position where it is lowered by a greater distance from said extension line.

22. A dry shaver as set forth in claim 11, wherein said trimmer unit includes a support on which the stationary and movable blades are mounted, said support being integrally formed with a trimmer drive operatively connecting the trimmer blade to a drive element for said inner blade assembly, said trimmer drive joining said support through a pair of resilient legs so that it is movable relative to the support.

* * * * *